United States Patent [19]

Frank

[11] 4,022,285

[45] May 10, 1977

[54] DRILL BIT WITH SUCTION AND METHOD OF DRY DRILLING WITH LIQUID COLUMN

[76] Inventor: Donald D. Frank, 805 NE. 3rd, Andrews, Tex. 79714

[22] Filed: Mar. 11, 1976

[21] Appl. No.: 665,963

[52] U.S. Cl. ..... 175/65; 175/213; 175/340

[51] Int. Cl.[2] ..... E21B 9/10

[58] Field of Search ..... 175/65, 340, 393, 213, 175/100, 339, 67, 72

[56] References Cited

UNITED STATES PATENTS

| | | | |
|---|---|---|---|
| 1,816,481 | 7/1931 | Hansen | 175/100 |
| 2,085,941 | 7/1937 | Arnold | 175/393 |
| 2,201,570 | 5/1940 | Zublin | 175/340 |
| 2,545,195 | 3/1951 | Crake | 175/393 |
| 2,849,214 | 8/1958 | Hall | 175/339 X |
| 3,111,179 | 11/1963 | Albers et al. | 175/393 |
| 3,923,109 | 12/1975 | Williams | 175/340 |
| 3,958,651 | 5/1976 | Young | 175/340 |

FOREIGN PATENTS OR APPLICATIONS

| | | | |
|---|---|---|---|
| 651,905 | 12/1964 | Belgium | 175/393 |
| 2,529,380 | 1/1976 | Germany | 175/340 |
| 1,104,310 | 2/1968 | United Kingdom | 175/340 |

*Primary Examiner*—Ernest R. Purser
*Attorney, Agent, or Firm*—Wendell Coffee

[57] ABSTRACT

A drill bit for drilling deep wells such as oil wells has a cone at the bottom and a fluid bore at the top. The fluid is directed by nozzles upward through a passageway so that the cone is maintained free of fluid and the cuttings from the cone are picked up by suction and carried through the discharge passageway. The jet from the discharge passageway supports the column of fluid surrounding the drill stem.

5 Claims, 5 Drawing Figures

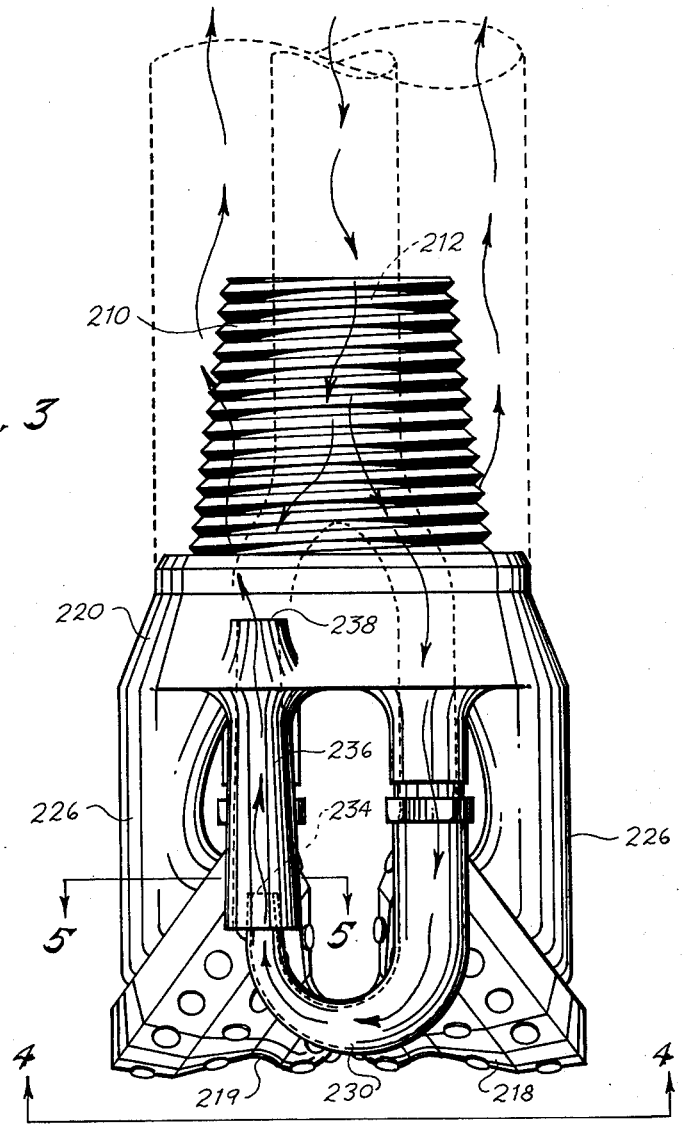
Fig. 3
Fig. 5
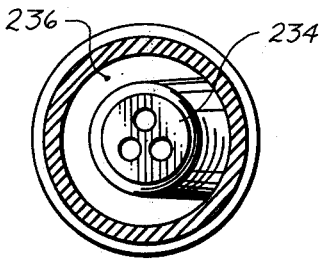
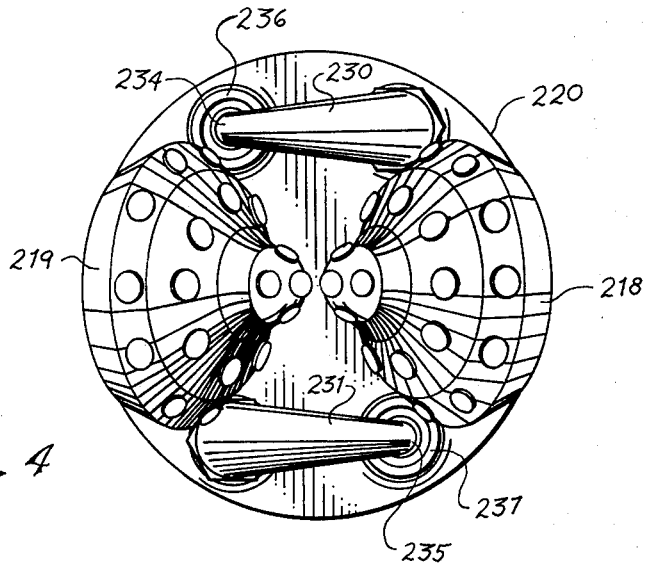
Fig. 4

DRILL BIT WITH SUCTION AND METHOD OF DRY DRILLING WITH LIQUID COLUMN

BACKGROUND OF THE INVENTION

1. Field of the Invention

This invention relates to a bit for earth boring and more particularly to a bit with a cone and a fluid conduit with the fluid directed upward.

2. Description of the Prior Art

In oil well drilling, bits having at least one cone are well known. These cones may have teeth projecting from them or they may be studded with diamonds for drilling in the earth. Also, it is well known to have a bore through the bit, the bore being connect through by the drill stem to a source of fluid under pressure. The drill bit itself rather than being connected directly to the drill stem may be connected to a reamer and the reamer itself connected to drill collars.

In the prior art, the drilling fluid, either drilling mud or air, is conventionally directed by nozzles against the cone to wash the cuttings from the cone. Often the results of the direction of the drilling fluid against the cone is to trap some of the cuttings along the bottom of the hole so the cuttings are ground to a powder before they are removed. In the case of air being used for the drilling fluid, this is successful as long as the bottom of the hole is dry and the drilling proceeds with the cuttings being removed. However, in case there is water or oil in the formations, often an abrasive paste is formed which is not effectively removed by the air.

I was aware of the following patents at the time of filing this patent application:

| | |
|---|---|
| Saunders | 270,488 |
| Reed et al | 1,378,056 |
| Samuelson | 1,678,201 |
| Dahl | 1,754,671 |
| Crake | 2,545,195 |
| Kirk | 2,647,726 |
| Wyman | 2,807,443 |
| Sandvig | 2,969,846 |
| Wenneborg et al | 2,730,592 |
| Mitchell et al | 3,775,805 |
| Buschmann | Nr201368 (German) |

SUMMARY OF THE INVENTION

New and Different Function

I have discovered that if drilling fluid, such as drilling muds, is jetted upward, the bottom of the hole can be kept dry and the upward jetting of the drilling mud will cause a suction which will readily remove the cuttings in large chips. By removing the cuttings in large chips, the power and the wear on the bit is reduced. Breaking the big chips into a powder not only requires power but also causes additional wear on the drilling bit. Further, bringing out large chips is an aid and advantage to geological analysis because more information can be gained from the larger chips. Therefore, it is possible to know more about the formations being drilled from the larger chips. Furthermore, if a wet material is being drilled through, the procedures according to my invention will quickly suck up the moisture so it does not form an abrasive slurry or an abrasive mud in the bottom of the hole, but it is quickly dried out so that rapid drilling continues.

The main advantage of this invention is the quick removal of the drill chips so that drilling proceeds faster with less bit wear. Also, as opposed to air drilling, there will be the weight of the fluid column or mud above the drilling to prevent blowouts and to seal pervious formations. Therefore, it may be seen that drilling according to my invention has most of the advantages of both air drilling and mud drilling.

Objects of the Invention

An object of this invention is to drill wells.

Other objects are to achieve the above with a device that is sturdy, compact, durable, simple, safe, efficient, versatile, and reliable, yet inexpensive and easy to manufacture, operate, and maintain.

Further objects are to achieve the above with a method that is versatile, rapid, efficient, and inexpensive, and does not require skilled people to operate and maintain.

The specific nature of the invention, as well as other objects, uses, and advantages thereof, will clearly appear from the following description and from the accompanying drawing, the different views of which are not necessarily to the same scale.

BRIEF DESCRIPTION OF THE DRAWINGS

FIG. 3 is a side elevational view of a two-cone bit according to my invention with fluid passages shown in dashlines.

FIG. 4 is a bottom view of the two-cone bit shown in FIG. 3.

FIG. 5 is a sectional view taken on line 5—5 of FIG. 3.

DESCRIPTION OF THE PREFERRED EMBODIMENTS

Figure 1:
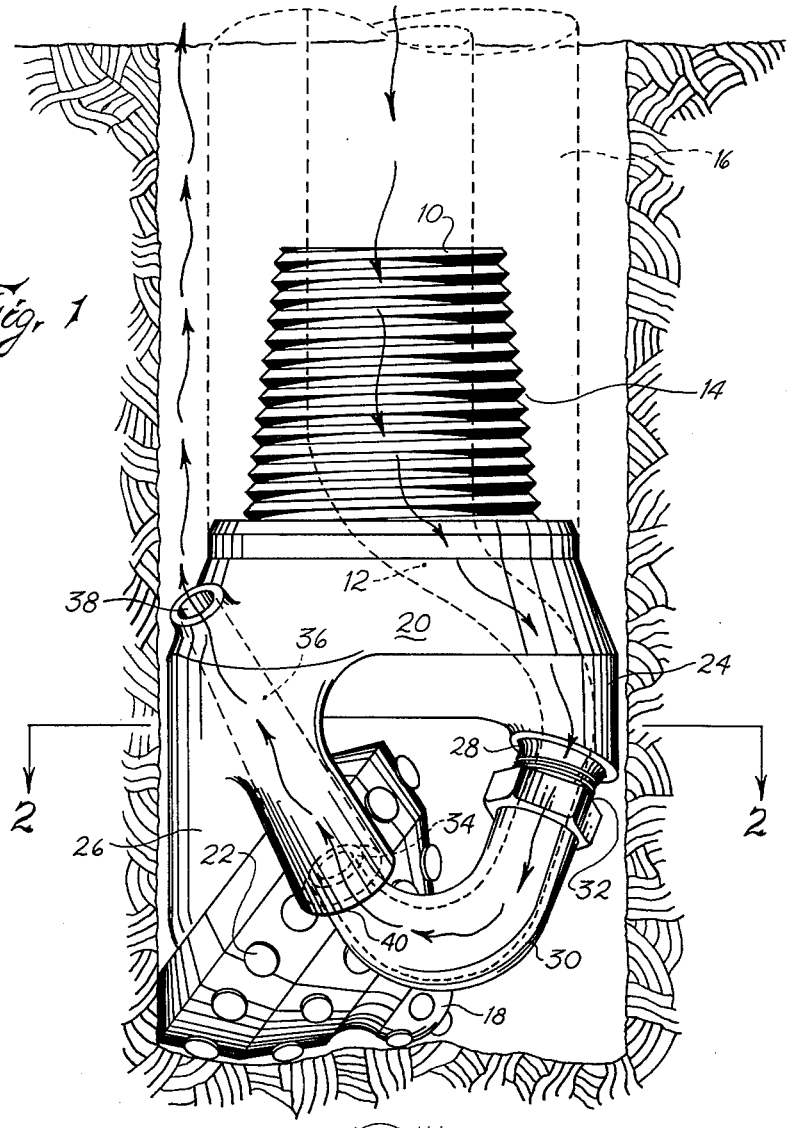
FIG. 1 is a side elevational view of a one-cone bit in the hole according to my invention with the fluid passages shown in dotted lines and the bottom of the drill string shown in phantom lines.
Figure 2:
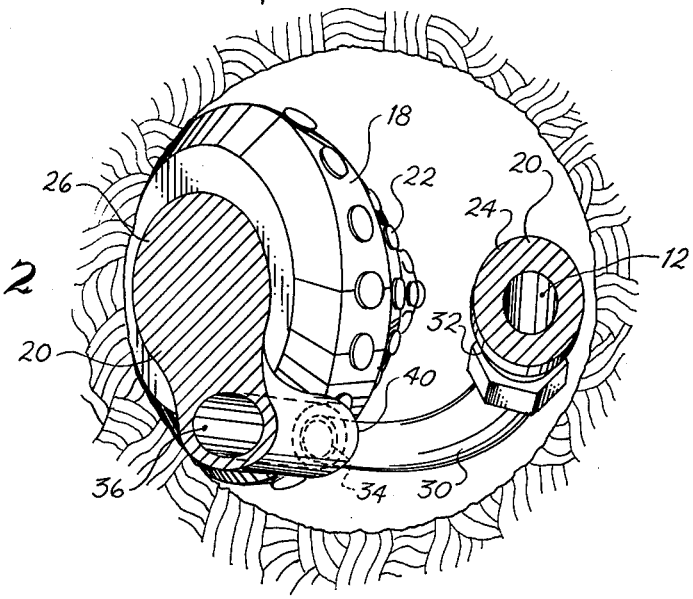
FIG. 2 is a sectional view thereof taken substantially on lines 2—2 of FIG. 1.

Referring to the drawing and more particularly to FIGS. 1 and 2 wherein there is shown a one-cone drill bit according to my invention. As is conventional, the bit has pin 10 forming a means for connecting bore 12 through the bit to a source of drilling fluid under pressure. The pin, of course, fits within a box of the bottom of drill string 16. Those skilled in the art will recognize as used herein that the bottom of the drill string may refer either to the bottom drill collar or to a reamer.

The pin 10 is at the top of the bit as is the bore 12 for the entry of the drilling fluid into the bit.

Cone 18 is on the bottom of the bit and it connects to body 20 of the bit by a single stub axle on the axle leg 26 as is well known in the art. As illustrated, the cone 18 has diamond studs 22 thereon for drilling hard surfaces. Those skilled in the art will understand that the cone could have teeth. As illustrated, the body 20 includes leg 24 opposite the axle leg 26 to which the cone 18 is connected. The leg 24 has the bore 12 extending down through it and terminates at threaded union terminal 28. Nozzle 30 is attached to the leg 24 by union 32 at the union terminal 28. Those skilled in the art will understand how to make a fluid tight connection by means of a union and further disclosure of this joint is omitted for brevity. Nozzle 30 is generally U-shaped so that discharge tip 34 of the nozzle is directed upward. The discharge tip of the nozzle is within discharge passage 36 which is formed within the body 20 of the bit.

The discharge passage extends up and discharge 38 of the discharge passage 36 is pointed upward. The discharge passage 36 itself is generally vertically oriented.

It will be understood that when a large volume of drilling fluid, commonly called mud, is pumped through the drill string into the bore 12 and through the nozzle 30 and out the tip 34 that it will form a suction or a partial vacuum at mouth 40 of the discharge passage 36. This suction will suck up all the chips and other material disloged by the drilling cone 18. Therefore, it is necessary that there be sufficient clearance between the nozzle tip 34 and the mouth of the passageway 36 for the chips to pass. I have had good success with the nozzle tip having an inside diameter of about one-half inch (13mm) and outside diameter of about three-fourths inch (20mm). The passageway 36 has an inside diameter of about 40mm.

It will be understood by those skilled in the art that the discharge passage 36 could have a taper thereto to increase the suction at the mouth 40. However, since the exact design of the shape is well within the skill of those having ordinary skill in the nozzle and venturi arts, this description is not burdened with the exact shape of these elements. Also, those skilled in the art will understand that the passageway 36 could have a liner of wear resistant material therein and not be merely a bore or passageway through the material of the body 20 of the bit.

It will be understood that it is desirable to have the suction low in the hole. As illustrated in FIG. 1, the suction is below the top of the cone 18. The diameter of the cone at the base is the maximum diameter of the cone and the bottom of the cone is the bottom of the bit. The mouth or the bottom of the discharge passage should be no more than one-half maximum cone diameter of the bottom of the bit. As illustrated in FIG. 1, the bottom of the discharge passage is about one-half of the maximum cone diameter of the bottom of the bit.

FIGS. 3, 4, and 5, illustrate a two-cone bit. It also has a bore 212 for drilling fluid to enter the bit at the top thereof. It likewise has a pin 210 forming a means for connecting the bore to a source of drilling fluid under pressure. There are two cones, cone 218 and cone 219. Each cone is attached to an axle leg 226 by a stud axle as is well known to those having ordinary skill in drill bits. The cones may be either toothed or diamond studded as illustrated. In this case there are two nozzles 230 and 231 extending downward from the body 220. The nozzles are connected with unions as before. The nozzle tips 234 and 235 are within discharge passages 236 and 237. In this embodiment, the nozzle tip has three diverging discharge ports to force three jets of fluid against the side at the discharge passage. As before, the discharge 238 from the discharge passages point upward. Therefore, as before, the jet of fluid discharged from discharge 238 will support the column in the annular space between the well bore and the drill string above the bit. The clearance between the reamer or drill collars immediately above the bit and the bore of the hole must be maintained small so that the force of the fluid discharged at 238 will support the fluid in the well above the bit. Therefore, the bottom of the well bore is kept dry and free of the drill fluid.

The drill fluid is used to carry the cuttings and chips upward once they are sucked upward through the discharge passages 236 and 237. The column of the drill fluid also prevents blowouts as is known in the drilling arts. However, since the bottom of the hole is kept free of the drilling fluid, there is a quick removal of the cuttings upward and away from the cutting area, which is the area at the bottom of the well. As discussed before, this distance is still within about one-half maximum cone diameter of the bottom of the bit. Normally the nozle tip will be within 2 inches (50mm) of the bottom of the bit.

As an aid to correlating the terms of the claims to the exemplary drawing, the following catalog of elements is provided:

| | |
|---|---|
| 10 pin | 210 pin |
| 12 bore | 212 bore |
| 16 drill string | 220 body |
| 18 cone | 218 cone |
| 20 body | 219 " |
| 22 studs | 226 axle leg |
| 24 leg | 230 nozzle |
| 26 axle leg | 231 " |
| 28 union terminal | 234 nozzle tip |
| 30 nozzle | 235 " " |
| 32 union | 236 discharge passage |
| 34 discharge tip | 237 " " |
| 36 "passage | 238 discharge |
| 38 discharge | |
| 40 mouth | |

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific examples above do not point out what an infringement of this patent would be, but are to enable the reader to make and use the invention.

I claim as my invention:

1. The improved method of drilling with a bit having a drilling fluid bore from the top connected to a source of drilling fluid under pressure and at least one cone journaled for rotation at the bottom comprising:

a. jetting all the drilling fluid upward from nozzles connected with said bore, b. jetting all said drilling fluid from the nozzles through a discharge passage in the bit, said discharge passage c. creating a low pressure in the passage, thereby d. sucking up chips drilled by said cone through a space between the nozzle and passage and inside the passage, and e. discharging the chips and fluid from the passage upward and outside the bit, f. holding the column of fluid discharged by the discharge passage up by the jet of fluid from the passage, thereby g. maintaining the area around the cone dry and free of drilling fluid.

2. In a drill bit having a. least one cone having a maximum diameter journaled for rotation at the bottom, b. a bore for drilling fluid at the top, and c. means for connecting said bore to a source of drilling fluid under pressure;

the improved structure comprising d. a nozzle i. fluidly connected to the bore, ii. having a discharge tip pointing upward, and iii. forming means for directing all fluid in the bore upward, e. a discharge passage through the bit in line with the discharge tip, thus pointing upward and discharging outside the bit, f. the bottom of the discharge passage is within one-half maximum cone diameter of the bottom of the bit, g. said discharge tip of the nozzle extending inside the discharge passage, and said discharge passage larger than the nozzle, thus forming h. a chip clearance between the nozzle and discharge passage, j. so that as fluid is pumped through the bore to the bit that a suction is formed at the discharge passage to suck up the chips through the discharge passage from around the cone.

3. The invention as defined in claim 2 wherein there are k. two cones and m. a nozzle and discharge passage for each cone.

4. The invention as defined in claim 3 with an additional limitation of n. the nozzle is attached to the bit by a union.

5. The invention as defined in claim 4 wherein said discharge tip has three outwardly diverging ports.

* * * * *